United States Patent [19]

Garcia Pelaez

[11] 4,338,176

[45] Jul. 6, 1982

[54] SYSTEM FOR GENERATING AND AUTOCONTROLLING THE VOLTAGE OR CURRENT WAVE FORM APPLICABLE TO PROCESSES FOR THE ELECTROLYTIC COLORING OF ANODIZED ALUMINIUM

[75] Inventor: Jose' Garcia Pelaez, Alicante, Spain

[73] Assignee: Empresa Nacional del Aluminio, S.A.-(ENDASA), Madrid, Spain

[21] Appl. No.: 83,943

[22] Filed: Oct. 11, 1979

[30] Foreign Application Priority Data

Oct. 31, 1978 [ES] Spain ..... 474.736

[51] Int. Cl.[3] ..... C25D 11/22; G05F 1/44

[52] U.S. Cl. ..... 204/228; 204/DIG. 9; 323/281; 330/265; 363/97

[58] Field of Search ..... 204/228-231, 204/DIG. 9, 204, 205, 211, 218, 223; 363/97; 330/259, 265, 271, 293, 297; 323/273, 281

[56] References Cited

U.S. PATENT DOCUMENTS

| | | | |
|---|---|---|---|
| 3,550,025 | 12/1970 | Stodolsky | 330/265 |
| 3,875,496 | 4/1975 | Carsten | 321/44 |
| 3,983,014 | 9/1976 | Newman et al. | 204/58 |
| 4,011,152 | 3/1977 | Rodriguez-Martinez | 204/228 |
| 4,041,367 | 8/1977 | Gold et al. | 363/97 |

OTHER PUBLICATIONS

John D. Lenk, Handbook of Modern Solid-State Amplifiers, Prentice-Hall, Inc., Englewood Cliffs, New Jersey, 1974, pp. 334-338.

*Primary Examiner*—Delbert E. Gantz
*Assistant Examiner*—William Leader
*Attorney, Agent, or Firm*—Wenderoth, Lind & Ponack

[57] ABSTRACT

A system for generating and autocontrolling the voltage or current wave form in a process for the electrolytic coloring of anodized aluminium includes feeding power from a source of symmetrical direct current, with a neutral connection directly coupled to a load, while the positive and negative voltages supplied by the source pass through a power control stage which is controlled by a bipolar operational amplifier. The bipolar operational amplifier has two signal inputs, a positive or non-inverting input which is connected to a signal generator, and a negative or inverting input having a signal which corresponds to the signal which actually exists on the electrodes of the electrolytic bath. This signal is processed in a half-wave outer controller which is controlled by a programming system.

7 Claims, 3 Drawing Figures

SYSTEM FOR GENERATING AND AUTOCONTROLLING THE VOLTAGE OR CURRENT WAVE FORM APPLICABLE TO PROCESSES FOR THE ELECTROLYTIC COLORING OF ANODIZED ALUMINIUM

BACKGROUND OF THE INVENTION

The present invention refers to a system for generating a voltage or current wave applicable to processes for the electrolytic colouring of aluminium, as well as to the system of autocontrolling same.

Electrolytic processes in general, and particularly processes for the electrolytic colouring, are faced with various limitations and difficulties of a diverse nature when an alternating current is used.

In this direction and in electrolytic processes, when two electrodes having a different nature are submerged in an electrolyte, the appearance of a continuous voltage therebetween is normal, which continuous voltage depends on the mentioned nature of said electrodes and on the composition of the electrolyte itself. If an alternating sine wave current is applied therebetween, the final result is that the previously mentioned polarization voltage is added to the alternate half-wave of the same sign and is deducted from that of the opposite sign causing an assymmetry, to a greater or lesser degree, with respect to the applied waveform.

More specifically, during processes for the electrolytic colouring of anodized aluminium, the layer of oxide which covers the metal presents two peculiar characteristics. Firstly, it is a very thin layer of oxide, that is—a nonconductor, which, when inserted between the metal and the electrolyte, acts as a condensor. Secondly, it has a greater facility for transporting electric charges from the metal to the electrolyte when the metal is negative, this facility being reduced when the metal is positive. This semi-conductor effect, together with the condenser effect, causes, when applying an alternating current, the positive half-wave with respect to the aluminium to present greater flow difficulties than the negative half-wave, giving rise in turn to drops in voltage differing from one direction to the other and, therefore, the waveform resulting from the applied voltage is not symmetrical; thus, there is a DC component to the applied electric signal, which is not always desirable. This is due to the semi-conductor effect. On the other hand, and due to the condensor effect, it is known that when an alternating current is applied between the aluminium and the other electrode, the condensor formed on the aluminium is charged to the peak voltage of the applied wave, the discharge being slower than the reduction in voltage due to the sine wave variation.

Thus, both the average value and the effectiveness of the resultant voltage are greater than those corresponding to the applied wave and, furthermore, they are variable in each case inasmuch as they are dependent upon the capacity of the anodic layer, the thickness thereof, the condition thereof, the process of obtaining same, etc.

This effect is particularly important in industry when thyristors are used to control the alternating current. In this case, due to the high capacity of the loads commonly used which can reach $5\times10^5$ microfarads, the resultant waveform can reach an average value almost double that corresponding to the applied voltage and, as always, exclusively dependent on the conditions and characteristics of the layer of oxide.

Thus, for the same applied alternating voltage, the resultant voltage varies in dependence upon the variation of the electric characteristics of the load, and consequently, it is very difficult to control. In processes such as that of electrolytic colouring, wherein the electrical energy should be applied with a very precise dosage, the previously mentioned effect becomes a serious drawback and various attempts have been made to overcome same by indirect control systems, but without success.

On the other hand, the use of thyristors in industry to control alternating currents or conduction angle-rectified currents, frequently gives rise to serious problems of radiofrequency interferences which is very difficult to overcome, such interference being a result of the functioning of a thyristor when the applied voltage is other than zero.

The generating system of the invention overcomes all these difficulties, achieving a perfect control of the wave used in the process.

SUMMARY OF THE INVENTION

This system of generating current is based on the use of an operational amplifier to control the voltage or current applied to the anodized aluminium for the electrolytic colouring thereof, as well as on the use of very high power transistors which facilitate the utilization of this equipment in industry, achieving the same advantages as those obtained when used in a laboratory.

The system comprises a source of symmetrical direct current with its corresponding transformer, rectifiers, filters, etc. which, from a three-phase supply network, supplies a positive and a negative voltage having the same value with respect to a central or neutral point which constitutes the feed of one of the electrodes.

From this source of supply, the system has a power control stage comprised of two groups of very high power transistors, a bipolar operational amplifier which controls the form of the voltage or the intensity which is to be applied to the load to be coloured, an outer controller of half-waves consisting of a group of discrete components having suitable values and conveniently arranged to process a detected signal corresponding to the voltage or current applied to the load and to apply the detected signal to the inverted input of the operational amplifier, a programming system formed of two time linear programming devices, one for programming the anodic wave and the other for programming the cathodic wave, and a signal generator which is connected to the positive or non-inverted input of the bipolar operational amplifier.

Finally, there is also provided a measuring and recording system which detects and separates the electric parameters of the current being applied to the aluminium, and which graphically records, depending on the time, the anodic and cathodic voltages and the anodic and cathodic currents.

A voltage or current wave, free at all times of any deformation, due to the autocontrolling thereof, is in this way applied to the electrolytic cell or bath at each moment, independently of the electric characteristics of the load to be coloured, such as its capacity, polarization, etc.

Since any type of wave can be used, without any deformation whatsoever, the use of sine waves completely prevents the problems of the appearance of radiofrequency interference, common to those systems which use thyristors having an adjustment effected by varying the conduction angle.

The load unbalances produced by the use of non-continuous signals are distributed along three three-phase distribution lines. Therefore, the system is always in equilibrium.

Since the reference signal is continuously compared with the voltage or current actually applied to the load and since both are made equal, the system is auto-stable either in voltage or in current. Therefore, once the initial conditions are fixed, they are maintained constant irrespective of the magnitude of the load to be coloured, and without the need of modifications or adjustments due to the load parameters.

The system permits any type of electric program to be applied to any type of colouring process, without having to modify the equipment. At the same time it is capable of proportioning programs for other electrolytic processes, such as anodization, deposition, etc.

It also permits the use of current frequencies other than those of the supply network, which are very advantageous in colouring programs.

Finally, it continuously records the variables participating in the process. Therefore, it is easy to control the function thereof, to detect the appearance of defects, to correct errors, to make statistic controls, as well as to completely automatize the process by providing constant monitoring.

BRIEF DESCRIPTION OF THE DRAWINGS

To complement the description which will subsequently be made and for a better understanding of the characteristics of the invention, a sheet of drawings is attached to this specification, forming an integral part thereof, wherein illustratively and not limitatively the following is represented.

DESCRIPTION OF THE PREFERRED EMBODIMENT

Figure 2:
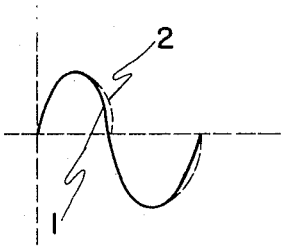
FIG. 2 illustrates a graphic representation of the resultant wave, compared with the applied wave due to the condensor effect.

It can be seen from these figures, and specifically from FIG. 2, according to the aforegoing comments, that due to the condensor effect, when an alternating current 1 is applied between the aluminium and the other electrode, a resultant wave 2 is obtained which determines an increase both in the average value and in the effective value of the resultant voltage, with respect to the applied wave 1.

Figure 3:
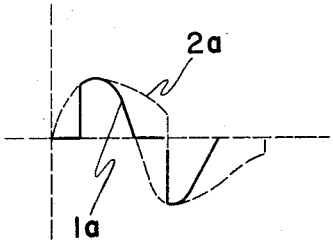
FIG. 3 PRIOR ART
FIG. 3 illustrates a graphic representation similar to the preceding figure wherein the same waves are compared, but when the applied wave is controlled by thyristors.

When, in the industrial installations, the alternating current is controlled by using thyristors, due to the great capacity of the loads used, the resultant wave can adopt the form referenced **2*a* in FIG. 3, from which it can be seen that the average value of the resultant voltage is almost double the value corresponding to the applied voltage 1*a*** and, as always, exclusively dependent upon the conditions and characteristics of the layer of oxide.

Figure 1:
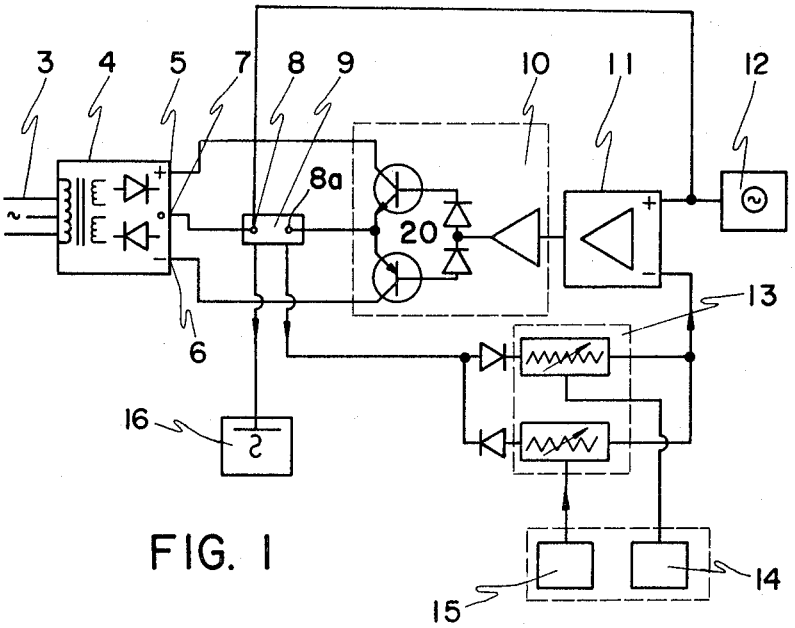
FIG. 1 illustrates the scheme of the system for generating and autocontrolling the voltage or current wave form applicable to processes for the electrolytic colouring of anodized aluminium, object of the present invention.

The system of the present invention, which is represented in the circuit of FIG. 1, overcomes these problems, obtaining a generation of the wave applied to the load, which is perfectly autocontrolled at all times.

The circuit consists of a three-phase supply network 3 including a rectifying transformer 4 by means of which a positive voltage 5 and another negative voltage 6 are obtained with respect to a central or neutral point 7 having a zero voltage.

This neutral point 7 directly constitutes the feed to electrode 8 of the electrolytic bath 9.

The other two voltages 5 and 6, supplied by the rectifying transformer 4, pass to a control stage 10 consisting of two groups of very high power transistors, one of which is a PNP type while the other is an NPN type, which control the electric parameters of the negative and positive signals, respectively, applied via electrode **8*a* to the load to be coloured and which is housed in the bath 9**.

Although for reasons of simplicity, PNP and NPN type transistors have been used in this scheme, the equipment can be provided with NPN type power transistors only by making suitable circuit modifications.

Besides, the circuit has a bipolar operational amplifier 11, which controls the form of the voltage or the intensity which is to be applied to the load to be coloured. It has two inputs, one of which is a positive or non-inverted input through which a low level signal, obtained from a generator 12, is applied to the operational amplifier 11, the form of which signal coincides with that to be applied to the load to be coloured. A signal from the electrode 8 connected to the neutral point 7 is also operatively connected to the non-inverted input. Series isolation resistors have been omitted from FIG. 1 to improve clarity. One skilled in the art would be aware of the fact that the generator 12 may be connected to the inverted input of amplifier 11 without changing the system operation. The other input that is, the negative or inverted input, receives the signal which actually exists on the electrode **8*a* connected to the junction point 20**, after having conveniently processed the signal present thereon.

The operational amplifier 11 compares at each instant the value, whether voltage or current, of the signal to be applied to the load with the value of the signal, at this same instant, which is actually applied to the load, so that the difference between both inputs, positive and negative, is zero. Therefore, the signal across to the load will be identical, in voltage or in current, to that applied by generator 12 to the non-inverted input of the amplifier 11.

As previously mentioned, the signal which actually exists in the electrode **8*a* supplied by junction point 20 is applied to the negative or inverted input of the operational amplifier 11, after same has been conveniently processed. This processing is carried out by an outer controller of half-waves 13, consisting of a group of discrete components, resistances, potentiometers, etc. having suitable values, so that when the such resistances are connected to electrode 8*a*, the signal detected by controller 13 will be the load voltage, and the signal applied to the load will have a voltage form which is identical to that of the reference supplied by the signal generator 12. In the same way, when detection is carried out by resistances (not shown) in series with the electrodes 8 and/or 8*a***, the signal detected by controller 13 will be that of the current intensity and, therefore, this signal will be identical to the form of the current intensity generated by the above mentioned generator 12.

With respect to the value of the mentioned discrete components, resistances, potentiometers, etc., the use of one or the other will vary the multiplier factor of the operational amplifier 11, i.e. its gain in voltage or in current and, since there are different controls for each one of the half-waves, for a perfectly symmetrical input signal, an output signal can be obtained in which the ratio of voltage or current of the positive half-wave to the negative half-wave has any desired value.

The programming system is comprised of two time linear programming devices, one of which, 14, programs the anodic waves while the other, 15, programs the cathodic wave. Basically they are formed of a resistance, the value of which is continuously varied to a previously selected value. When there is a variation in the value existing in the half-wave controller 13, used for varying the gain of the operational amplifier 11, the multiplier capacity of same varies lineally, depending on time and adopting the form of a $G=f(t)$ function, both for the anodic wave and for the cathodic wave.

The signal generator 12 is capable of producing any type of signal, continuous or alternating, having a great versatility, permitting sine waves, triangular waves or square waves, to be obtained at continuously adjustable frequencies between 0.1 Hz and 5 MHz, with the possibility of producing assymetrical sweeping and an adjustable ratio between active and inactive periods, as well as a variable ratio between the anodic and cathodic values, a mixture of continuous and alternating signals, etc.

Finally, the circuit has a measuring and recording system referenced 16 in FIG. 1, comprising electronic equipment which detects and separates the electric parameters of the current applied to the aluminium to be coloured, proportioning an instantaneous measurement as well as a graphic recording of the variation in time of the anodic and cathodic voltage and of the anodic and cathodic current.

This measuring and recording system 16 facilitates the functioning of the process for the electrolytic colouring to be followed rather easily, enabling the appearance of defects to be detected, errors to be corrected, statistic controls to be made and, naturally, it completely automates the process in that it provides continuous system monitoring.

I claim:

1. A system for generating and controlling one of either the voltage and current waveform applied to a load having first and second terminals and applicable to a process for the electrolytic colouring of anodized aluminium, said system comprising:

a symmetric bipolar DC power supply having positive and negative output voltage terminals and a neutral terminal, said neutral terminal operatively connected to said first terminal of said load;

a power control stage having at least two transistors operating in a linear mode, said power control stage operatively connected between said positive and negative output voltage terminals of said power supply and said second terminal of said load;

an operational amplifier operatively connected to said power control stage for controlling said power control stage, said operational amplifier having a non-inverting input operatively connected to said neutral terminal of said power supply and having an inverting input operatively connected to said second terminal of said load;

a negative feed-back means operatively connected between said inverting terminal of said operational amplifier and said second terminal of said load, said feed-back means comprising two unipolar electrical resistance paths connected in parallel, said electrical resistance paths separately controllable by a programming system;

a signal generator operatively connected to said non-inverting input of said operational amplifier for providing a periodic signal of predetermined characteristics;

wherein said programming system controls said resistance paths of said feed-back means to control one of either the voltage or current waveform applied to said load.

2. A system as in claim 1, wherein said power control stage comprises first and second groups of power transistors, said first and second groups being of opposite conductivity and arranged such that said first group controls a current flowing in a first direction and said second group of transistors controlling a current flowing in a direction opposite of said first direction;

the emitters of said first and second groups of transistors operatively connected to said second terminal of said load and the respective collectors of said first and second groups of transistors operatively connected to said positive and negative output voltage terminals of said power supply.

3. A system as claimed in claims 1 or 2, wherein said signal generator provides signals having a waveform comprising one of either a sinusoidal, triangular, or square waveform; said signal having a frequency in the range of between 0.1 Hz and 5 MHz;

said signals having a variable duty cycle and variable average DC level.

4. A system as claimed in claim 3, further comprising a recording system operatively connected to said load for recording the waveform of the current applied to said load.

5. A system as in claims 1 or 2, wherein said programming system comprises first and second programming devices operatively connected respectively to said first and second resistance paths of said feed-back means, and respectively controlling the resistances thereof;

said first and second programming devices controlling said first and second resistances in a predetermined time varying fashion, wherein a current applied to said load in a first direction and a current applied to said load in a direction opposite said first direction are separately varied in a predetermined time varying fashion.

6. A system as claimed in claim 3, wherein said signal generator provides signals having a waveform comprising one of either a sinusoidal, triangular, or square wave form; said signal having a frequency in the range of between 0.1 Hz and 5 MHz;

said signals having a variable duty cycle and variable average DC level.

7. A system as claimed in claim 6, further comprising a recording system operatively connected to said load for recording the waveform of the current applied to said load.

* * * * *